US006990781B2

(12) United States Patent
Sundstrom

(10) Patent No.: US 6,990,781 B2
(45) Date of Patent: Jan. 31, 2006

(54) DECKING ASSEMBLY WITH AN INTERLOCKING SEAM STRUCTURE

(75) Inventor: Michael Sundstrom, West Sacramento, CA (US)

(73) Assignee: Varco Pruden Technologies, Inc., Memphis, TN (US)

( * ) Notice: Subject to any disclaimer, the term of this patent is extended or adjusted under 35 U.S.C. 154(b) by 0 days.

(21) Appl. No.: 10/299,041

(22) Filed: Nov. 18, 2002

(65) Prior Publication Data

US 2004/0093820 A1 May 20, 2004

(51) Int. Cl.
*E04B 2/00* (2006.01)

(52) U.S. Cl. ..... 52/586.1; 29/432.2; 29/521; 29/52; 29/591.2

(58) Field of Classification Search ..... 52/586.1, 52/584.1, 589.1, 591.2, 591.4, 591.5, 592.1, 52/745.08, 745.12, 745.13, 748.1, 749.12, 52/747.1, 528, 536, 539; 72/325, 326, 409.12, 72/451, 453.15, 409, 410, 412; 29/505, 243.5, 29/283.5, 509, 33 R, 432.2, 521
See application file for complete search history.

(56) References Cited

U.S. PATENT DOCUMENTS

| | | | | | |
|---|---|---|---|---|---|
| 824,551 | A | * | 6/1906 | Levis | 72/327 |
| 2,964,829 | A | * | 12/1960 | Spengler | 29/21.1 |
| 3,624,876 | A | * | 12/1971 | Irving | 29/267 |
| 4,531,397 | A | | 7/1985 | Pratt | |
| 5,761,948 | A | * | 6/1998 | Malagnoux | 72/325 |
| 5,884,405 | A | * | 3/1999 | Breeden | 30/366 |
| 6,212,932 | B1 | | 4/2001 | Parker | |
| 2001/0010168 | A1 | | 8/2001 | Parker | |
| 2001/0039704 | A1 | | 11/2001 | Parker | |

* cited by examiner

*Primary Examiner*—Ramon O Ramirez
(74) *Attorney, Agent, or Firm*—Egbert Law Offices

(57) ABSTRACT

A decking assembly having a first deck section with a male leg and a second deck positioned adjacent to and in overlapping relationship to the first deck section. The second deck section has a female leg overlying the male leg of the first deck section. The male leg and the female leg have a triangular tab formed therethrough such that the triangular tab extends outwardly on one side of the female leg so as to secure the edges of the sections together in secure relationship. A plurality of triangular tabs are formed in spaced relationship to each other.

4 Claims, 9 Drawing Sheets

DECKING ASSEMBLY WITH AN INTERLOCKING SEAM STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to assemblies and methods of action of the joints of structural steel decking and roofing. More particularly, the present invention relates to methods of connecting the edges of such decking in roofing sections together through the use of a stylized cut formed in the overlapping edges of such decking sections.

BACKGROUND OF THE INVENTION

In the construction of modern buildings, there is erected a steel skeleton. It is necessary to have floors in the building. The floors are generally concrete floors. Also, in other forms of construction, steel buildings will have steel roofing.

In the construction of buildings, the steel skeleton has steel beams. Steel forms are placed on the steel beams and also the supports for the floors. Then, freshly mixed concrete is poured onto the steel forms and is allowed to cure. In order to have concrete floors, it is necessary to definitely position the steel forms onto the beams and also onto the supports of the steel forms. Further, it is necessary to definitely position the steel forms with respect to each other. The steel forms are typically corrugated sheets of steel. On one side of the sheet of steel, there is an upright edge. On the other side of the sheet of steel, there is an envelope to receive the upright edge of the adjacent sheet of steel.

The steel forms are laid on the beams and on the supports for the steel forms so that the envelope of the first steel form receives the upright edge of the second steel form, and, likewise, the envelope of the second steel form receives the upright edge of the third steel form. This is repeated until there are sufficient steel forms on the beams and on the supports of the steel forms to receive the freshly mixed, uncured concrete.

The adjacent steel forms are bonded together. At the present time, the adjacent steel forms are manually bonded together by a manually operated crimping tool. The operator actuates the crimping tool and makes a dent in each side of the envelope of the steel form and also in the upright edge of the next adjacent steel form. The dent definitely positions the steel forms with respect to each other. Also, a welder may tack weld the steel form to the beam so as to definitely position the steel forms with respect to the beams. After the steel forms have been positioned on the beams and onto the supports for the steel forms, and also definitely positioned with respect to each other, uncured concrete can be poured onto the top of the steel forms. The weight of the uncured concrete assists in positioning the steel forms onto the beams. In time, the concrete cures and bonds to the steel forms so as to position the steel forms onto the beams.

As previously stated, the operator manually crimps the adjacent steel forms to each other. The operator can take a crimping tool and walk on the steel forms and crimp together the adjacent steel forms. The manual crimping of the adjacent steel forms is a slow process since the operator cannot rapidly operate the manual crimping tool. Further, in time, the operator tires after operating the manual crimping tool and slows down in his work.

A similar process is also involved with the formation of structural steel roofing. Unlike with structural steel flooring, there is no concrete poured onto the upper surface of the roofing. Since the roofing panels are joined together in the same manner as the decking panels, it is important that the joints are secured together so as to prevent one panel from lifting off the other. It is also important to prevent the panels from shifting laterally with respect to each other along the seam. In view of the inherent forces created by ambient conditions, such as wind, there is a weakness associated with crimped joints. As a result, supplementary operations must be carried out so as to properly join the roofing sections together. These supplemental operations can include welding and screwing of the seam to the extent necessary to satisfy the shear strength requirements of the roofing. Ultimately, the roof sections must be joined together with sufficient integrity to prevent the panels from separating from each other or shifting laterally under the presence of high wind conditions.

In the past, various patents have issued with respect to such crimping tools. For example, U.S. Pat. No. 4,531,397, issued on Jul. 30, 1985 to R. Pratt, describes a crimping tool which is power operated. This crimping tool has two movable links. There is a stud on the lower end of one of the movable links and a recess on the lower end of the other movable link. A power-operated movable piston is operatively connected to a plunger. The plunger connects with suitable toggles and, in turn, the toggles connect with an appropriate movable link. The operator can control the application of power to the power-operated movable piston so as to move the piston and thereby move the plunger and thereby move the toggles and the associated two movable links. The dies located on the end of the crimping tool will provide a power-driven crimp to the adjoining sections of steel decking and roofing. Unfortunately, this device is only used for crimping the upward exposed "male" lip with the female inverted "U"-shaped lip. The seam is crimped at periodic intervals by this crimping tool.

U.S. Pat. No. 6,212,932, issued on Apr. 10, 2001, to J. R. Parker, describes a power-assisted combination shear used for forming structural louvers in the crimped seam of structural steel decking. This shear includes a frame supporting a pair of jaws which are opened and closed by means of an operator-controlled pneumatic cylinder. One jaw terminates in a blade while the other jaw has a corresponding die member. The blade and the die have undercut reliefs in the root portions, which permit the louver to be formed without breaking through to the edge of the seam. The louver comprises a sheared portion in the form of a bowed tab bridging a corresponding window formed in the seam by the shearing of the tab. The interference between the louver and window provides a substantial increase in the lateral resistance (shear strength) of the crimped seam. As such, the device is intended to eliminate the need to additionally weld or screw the seams of the steel decking. U.S. Publication No. 2001/0010168, published on Aug. 2, 2001, is closely related to U.S. Pat. No. 6,212,932, and describes a method of securing work pieces together through the unique configuration of the jaws of the power-assisted combination shear.

Similarly, U.S. Publication No. 2001/0039704, published on Nov. 15, 2001, describes an arrangement similar to that of the prior publication and U.S. Pat. No. 6,212,932. In particular, this patent shows the actual steel structure as having the arrangement of louvers connected in an overlying and interconnected relationship.

Unfortunately, there are many problems associated with the prior art patents to Parker and the prior art patent to Pratt. Fundamentally, whenever it is necessary to have two pivotable arms for the purpose of forming the crimp or the louvers, there is a great potential for misalignment of the arms. Each of the linkages associated with each of the pivotable arms must move in perfect coordination so as to achieve the proper operation. It is known that over time, the various bearings and connections between the linkage members can wear after repeated usage. As the tolerances change between the respective dies associated with the pair of pivotal arms, there is a strong possibility of misalignment between the dies. When a misalignment occurs, the effective seal between the deck sections and roofing sections can become compromised. Furthermore, the use of a pair of pivotable arms can require additional maintenance and repair. Often, the application of power will be more to one side of the leading die arrangement while less on the opposite side of the mating die arrangement. Once again, an insufficient and inappropriate cut louver or ineffective crimp, can occur. Additionally, in the case of the Parker patent, and the associated applications, the particular dies associated with forming the louver are unnecessarily complicated. Ultimately, if any of the surfaces associated with the die of the Parker patent should become worn or distorted with time, the louver will have an undesired configuration or may ineffectively join the sections of steel decking together. The Parker patent relies on a blade-type male die for the formation of the cuts into the female die. It is known that such arrangement can become dull with time and use.

It is an object of the present invention to provide a connection for decking sections which requires reduced cutting forces to connect the sections together.

It is another object of the present invention to provide a method for connecting decking sections together which produces bearing surfaces for resisting shear movements of the deck panels.

It is a further object of the present invention to provide a method of connecting decking sections together which produces diaphragm shear values equal to or better than seam welding procedures.

It is a further object to the present invention to provide a method of joining decking sections together which reduces installation costs.

It is a further object to the present invention to provide a method for securing decking sections together which can be carried out with a tool that is operable by unskilled personnel.

It is a further object to the present invention to provide a method of connecting decking sections together which produces more seam attachments per hour than welding procedures.

It is a further object to the present invention to provide a method for connecting decking sections together which reduces health issues for installers and other personnel.

It is a further object to the present invention to provide a decking assembly which effectively resists vertical loads.

It is still a further object to the present invention to provide a decking assembly which allows operators and inspectors to easily verify proper connections between the sections.

It is still a further object to the present invention to provide a method of joining decking sections together which avoids the requirements for touch-up painting and eliminates burn marks.

These and other objects and advantages of the present invention will become apparent from a reading of the attached specification and appended claims.

BRIEF SUMMARY OF THE INVENTION

The present invention is a decking assembly comprising a first deck section having a male leg and a second deck section positioned adjacent to and in overlapping relationship to the first deck section. The second deck section has a female leg overlying the male leg of the first deck section. The male leg and the female leg have a triangular tab formed therethrough such that the triangular tab extends outwardly on one side of the female leg.

In the present invention, the female leg has a first surface positioned on one side of the male leg and a second surface positioned on an opposite side of the male leg. The triangular tab is defined by a first inverted V-shaped cut formed in the second surface and bent inwardly toward the first surface. The triangular tab is further defined by a second inverted V-shaped cut formed in the male leg and bent inwardly toward the second surface of the female leg. Additionally, the triangular tab is defined by a third inverted V-shaped cut formed in the first surface of the female leg and bent away from the second surface. These inverted V-shaped cuts are arranged so as to be overlying relationship to each other. In particular, the cuts define the triangular tab and are offset from each other such that the surfaces of each of the cuts is visible from above. The female leg is crimped such that the male leg is sandwiched between the surfaces of the female leg.

In the present invention, the triangular tab extends generally perpendicular to the female leg and to the male leg. In the preferred embodiment of the present invention, the triangular tab includes a first triangular tab, a second triangular tab and a third triangular tab each extending in spaced relationship to each other. Each of the tabs is spaced approximately one inch from each other. The base of the tabs is approximately 5/16" with a height of approximately 3/8".

The present invention is also a method of affixing a first deck section to a second deck section comprising the steps of: (1) positioning the female leg so as to be overlying relationship to the male leg; and (2) forming a first triangular tab extending outwardly through the female leg.

In the method of the present invention, the male leg of the first deck section is inserted between the first and second surfaces of the female leg. The step of forming the first triangular tab includes shearing a first inverted V-shaped cut in the second surface of the female leg, shearing a second inverted V-shaped cut in the male leg, and shearing a third inverted V-shaped cut in the first surface of the female leg. These inverted V-shaped cuts are bent in a direction toward the first surface of the female leg and away from the second surface of the female leg. The bent cuts will overly each other and extend in generally transverse relationship to the male and female legs. These cuts are suitably bent so that they will reside in offset overlying relationship to each other.

DETAILED DESCRIPTION OF THE INVENTION

Figure 1:
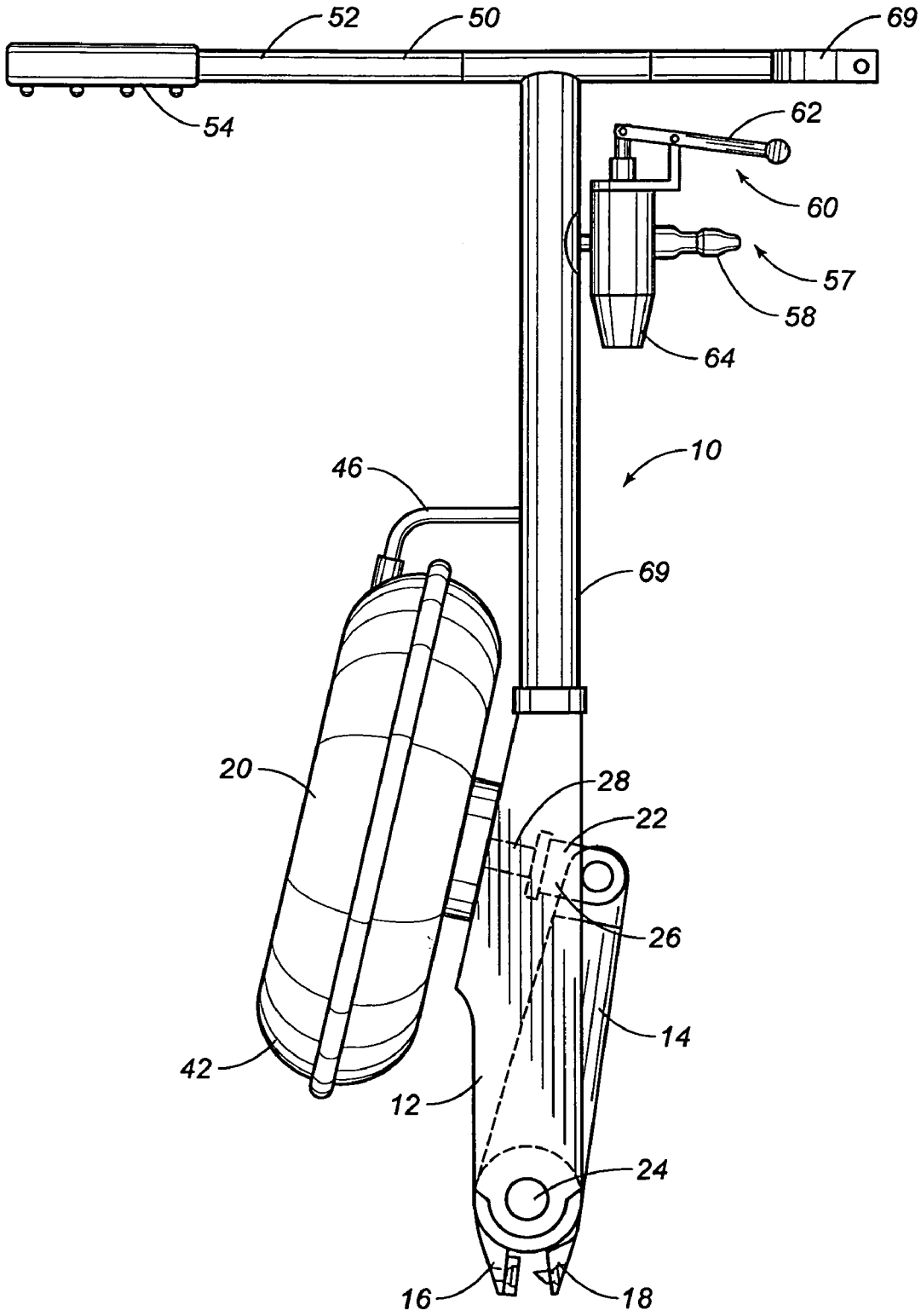
FIG. 1 is a side elevational view showing the punching tool as used by the method of the present invention with the dies in their open position.

Referring to FIG. 1, there is shown the punch tool 10 as used for the assembly of the decking sections of the present invention. The punch tool 10 includes a frame 12, a punch arm 14 pivotally mounted on the frame 12, a die 16 fixedly and non-pivotally supported by frame 12, a mating die 18 affixed to the punch arm 14, and an actuator 20 interconnected to the punch arm 14 for moving the mating die 18 relative to the die 16. A linkage 22 is used so as to connect the actuator 20 to the punch arm 14.

As used herein, the term "decking sections" and "decking assembly" referred to such panels of steel and other metallic material that are used for structural steel decking, roofing and flooring in the formation of buildings, components of building or other structures.

As can be seen in FIG. 1, the die 16 is formed at the bottom end of the frame 12. The die 16 is aligned with the die 18 so that the dies 16 and 18 will suitably mate with each other when the punch arm 14 is pivoted about its pivotal connection 24 with the frame 12. The linkage 22 is a clevis connected between the actuator 20 and the punch arm 14 so as to suitably pivot the punch arm 14 between a first position in which the mating die 18 engages the die 16 and a second position, shown in FIG. 1, in which the mating die 18 is spaced from the die 16.

In FIG. 1, it can be seen that the die 16 is a female die and that the mating die 18 is a male die. When the punch arm 14 is moved into the first position, the male die 18 will enter the female die 16 so as to form the cut between the sections of steel decking. The particular configuration of the relationship of the dies 16 and 18 is shown in FIGS. 9-12, as will be described hereinafter.

Figure 5:
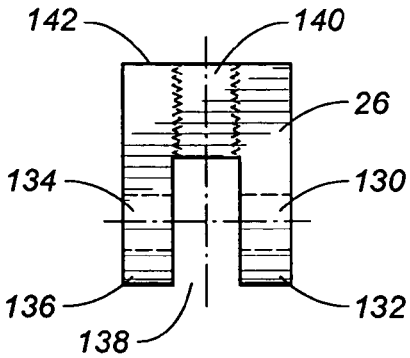
FIG. 5 is a detailed view of the clevis of the punch tool.

The linkage 22 associated with the punch tool 10 serves to connect the actuator 20 with the punch arm 14. The linkage 22 includes, in particular, a clevis 26 (as shown in FIG. 5) connected to the actuator 20. In particular, the clevis 26 is suitably threadedly connected, or otherwise connected, to the piston rod 28 of the actuator 20.

In FIG. 1, it can be seen that the actuator 20 includes an air can 42 which is affixed to the frame 12. The air can 42 has a piston-and-cylinder arrangement therein (as shown in greater detail in FIG. 4). A piston rod 28 will extend outwardly from the air can 42 so as to be connected to the clevis 26. In particular, piston rod 28 will have a longitudinal axis which extends at an acute angle with respect to the frame 12. The air can 42 is mounted on one side of the frame 12. The piston rod 28 extends across the frame 12 so as to have an end connected to an opposite end of the punch arm 14 opposite the mating die 18. The piston rod 28 is connected to a piston supported interior of the cylinder of the air can 42. A spring, or other resilient member, is affixed within the air can 42 so as to urge the piston rod 28 toward the opposite side of the air can 42 from the frame 12 such that the punch arm 14 will assume the position shown in FIG. 1. An air supply line 46 is connected to the interior of the air can 42 so as to deliver air to one side of the piston located within the air can 42. Air supply line 46 communicates with a source of pneumatic pressure for the delivery of air thereinto.

Figure 13:
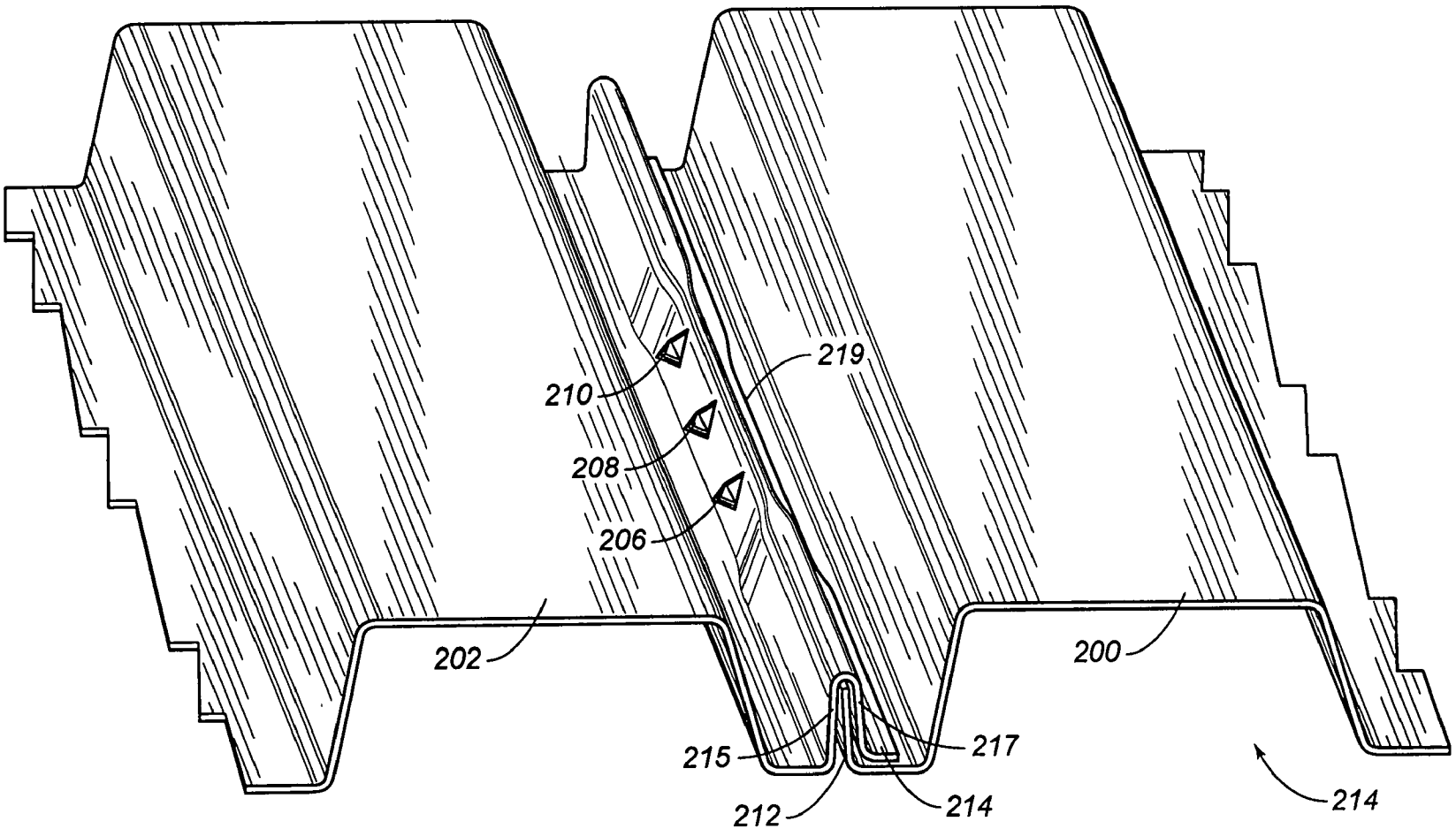
FIG. 13 is a perspective view of the decking assembly in accordance with the preferred embodiment of the present invention.
Figure 14:
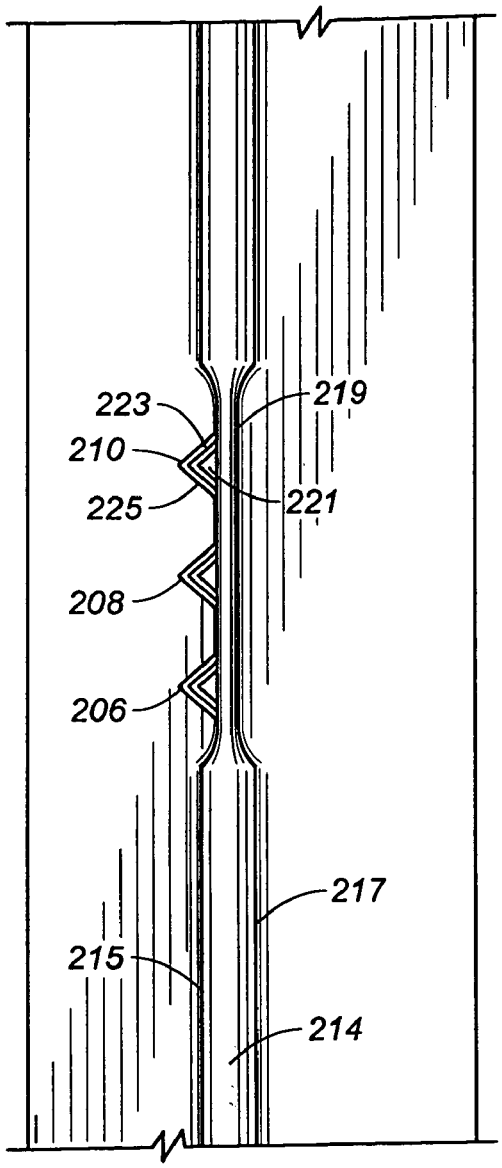
FIG. 14 is a plan view of the decking assembly of the present invention.
Figure 15:
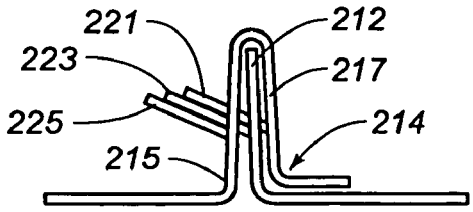
FIG. 15 is an end view showing the connections of the decking assembly in accordance with the preferred embodiment of the present invention.

A handle 50 is connected to the top end of the frame 12 so as to provide support for the frame 12. Handle 50 is made up of a bar 52 which extends transversely to the frame 12. Bar 52 has a gripping portion 54 at one end thereof and a handle portion 56 at an interior end thereof. The handle portion 56 is in a position closer to the frame 12 than the gripping portion 54. The handle portion 56 should be suitably close to the trigger mechanism 60 so as to allow the operator to access the trigger mechanism 60 for the delivery of air pressure into the actuator 20 and for the proper use of the punch tool 10 of the present invention. During normal use, the gripping portion 58 and the handle portion 56 of handle 50 will be grasped by the worker for the manipulation of the opposite end of the punching tool 10 during the punching of the steel deck connections associated with the present invention as shown in FIGS. 13–15.

The actuator 20 of the punch tool 10 also includes a source of air pressure 56 which is connected to inlet 58 associated with the trigger mechanism 60. Trigger mechanism 60 includes a lever 62 suitably positioned close to the end of portion 56 of handle 50. As such, the lever 62 will be in a proper position for easy actuation by the worker using the handle 50. The lever 62 associated with the trigger mechanism 60 can be lifted so as to open the air valve 64 and allow air to pass through the inlet 58, through the air hose 46, into the air can 42. When the lever 62 is released, the spring action of the air valve 64 will return the lever 62 to its desired position.

In normal use, when the trigger mechanism 60 is actuated, air will flow through inlet 58 through the air hose 46 so as to create a pushing force on the piston within the air can 42. This, in turn, will move the piston rod 28, and the associated clevis 26, outwardly. As a result, the punch arm 14 will move angularly outwardly of the frame 12 so as to bring the male die 18 toward the female die 16. This will cause a punch of the adjoining deck sections located in the space between the male die 18 and the female die 16. When the trigger mechanism 60, and its associated lever 62, is released, the spring within the air can 42 will urge the piston upwardly within the air can 42. This will cause the piston rod 28, and the associated clevis 26, to move inwardly.

The air can 42 can take a wide variety of configurations. For example, the air can 42 can be placed in other locations on the frame 12 while still achieving the same punching results. In particular, a variety of other linkages can be implemented so as to allow for the proper movement of the punch arm 14. As used herein, the term "actuator means" can also take on a wide variety of configurations. For example, it is possible for the actuator to actually work by having the air supply retract the piston within the air can 42. As a result, through suitable linkages, the male and females dies can move in an opposite orientation to that described in FIG. 1. It is possible that hydraulics could be used in place of pneumatics associated with the actuator means. The actuator means can be placed in various locations associated with the handle 50 or with the frame 42. The actuator means shown in FIG. 1 is not intended to limit the broad scope associated with the concept of the present invention. Various other operable arrangements of the "actuator means" can also be used.

Figure 2:
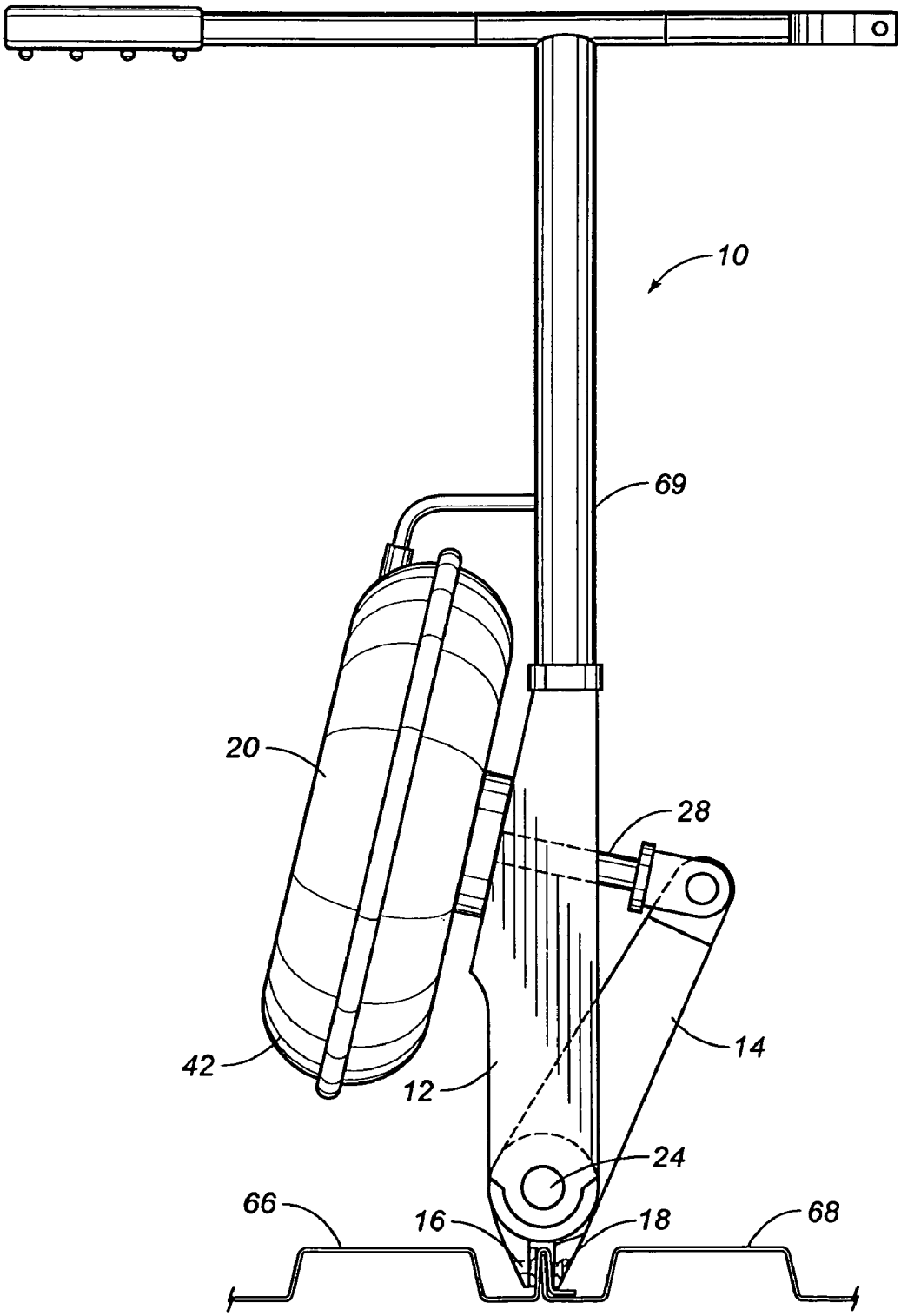
FIG. 2 is diagrammatic illustration of the tool as used by the method of the present invention showing the dies in their closed position with respect to sections of metal decking.

FIG. 2 is an illustration of the punching tool 10 as used for the joining of the deck sections 66 and 68 of the present invention. It can be seen that the deck sections 66 and 68 will have an envelope portion (a female leg) and a lip portion (a male leg) sandwiched together within the space between the male die 18 and the female die 16 on the end of frame 12 of punch tool 10. The trigger mechanism 60 has been omitted from the illustration of FIG. 2. When the trigger mechanism is actuated, the actuator 20, and, in particular, the air can 42 is actuated so as to urge the piston rod 28 outwardly therefrom. As a result, the punch arm 14 will pivot about pivot point 24 so as to be at a greater angle relative to the longitudinal axis of the frame 12. As a result, the male die 18 will strongly move toward the female die 16 so as to carry out the requisite crimping and punching operation for the joining of deck sections 62 and 68 together in accordance with the present invention.

Figure 3:
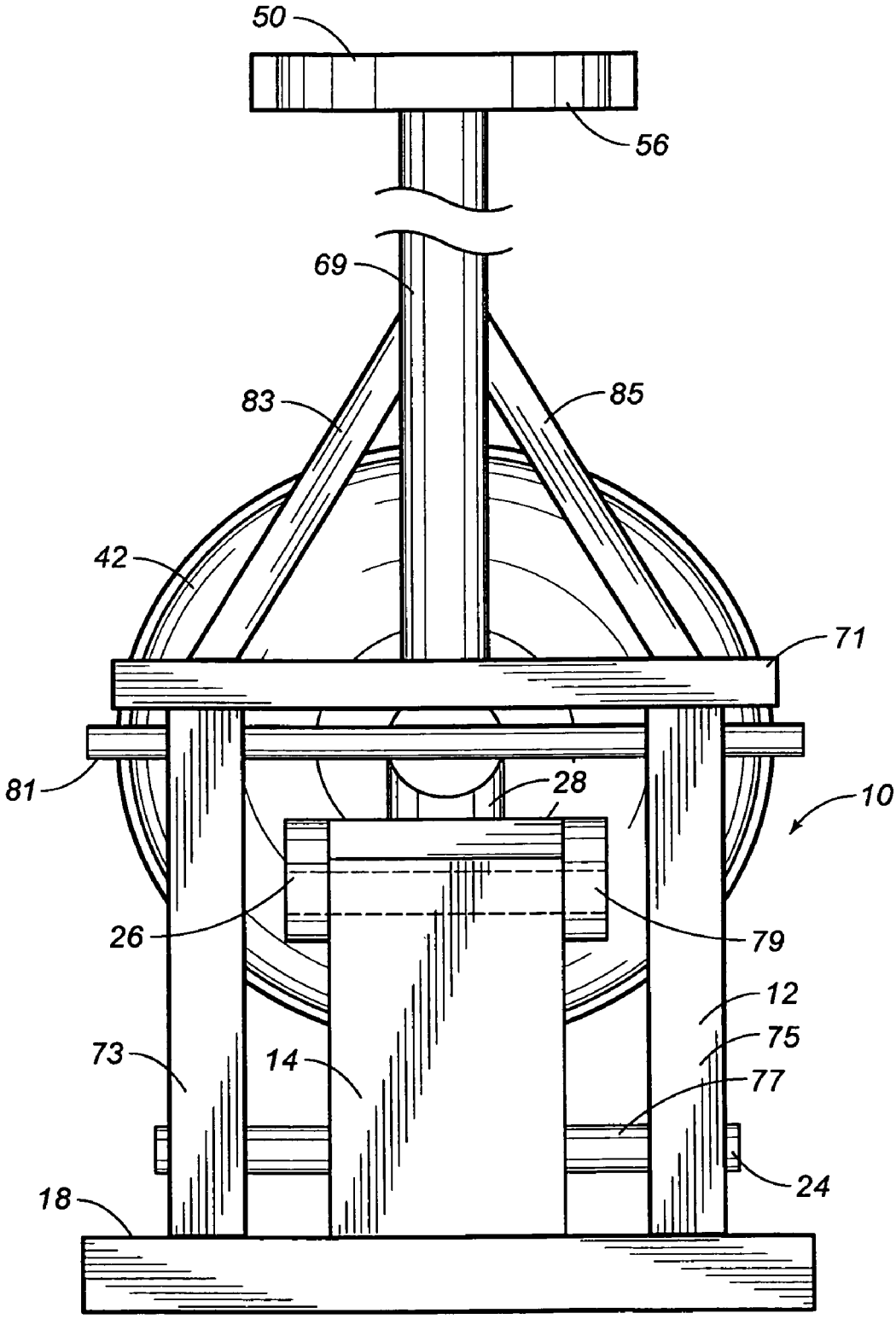
FIG. 3 is an end view of the punch tool as used by the method of the present invention.

FIG. 3 shows an end view of the punch tool 10. In particular, in FIG. 3, it can be seen that the frame 12 has an upper strut 69 extending upwardly from support plate 71. The frame 12 also includes parallel and spaced apart lower support sections 73 and 75 extending downwardly to the male die 18. The male die 18 is shown as supported by punching arm 14. The punching arm 14 is pivotally mounted at 24 upon a shaft 77 extending between the support frame members 73 and 75. The punch arm 14 is also pivotally connected at 79 to the clevis 26 and, in turn, to the piston rod 28 extending outwardly from air can 42. The air can 42 is supported on a plate 81 rigidly affixed to the frame 12. Gussets 83 and 85 will extend from crossbar 71 and be affixed to the central upper strut 69. The end of handle 50 is shown with the handle portion 56 particularly illustrated.

Figure 4:
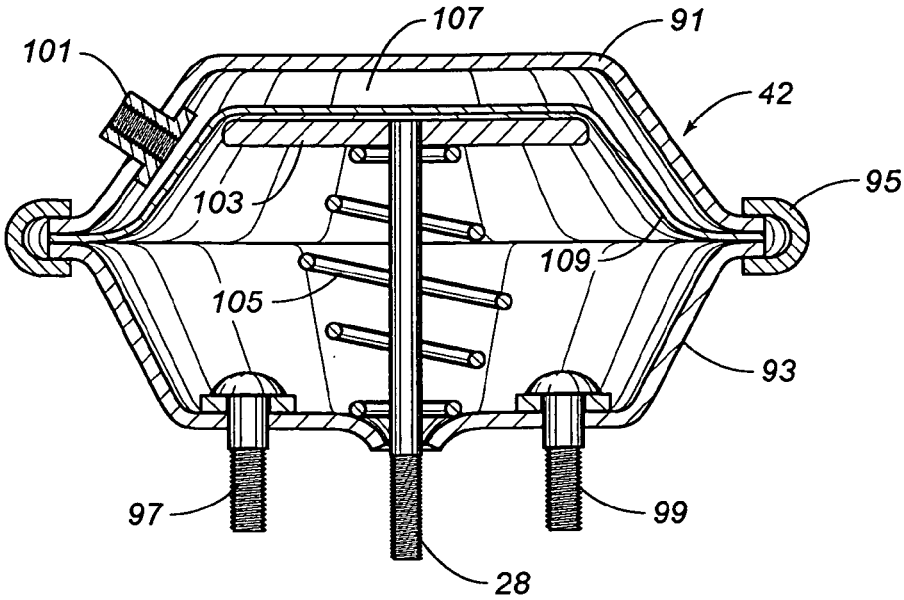
FIG. 4 is a cross-sectional view showing the piston-and-cylinder assembly used in the punch tool of the present invention.

FIG. 4 shows an illustration of the air can 42 associated with the punch tool. Air can 42 is particularly made of upper cannister 91 and lower cannister 93 joined together by a clamping band 95 around the periphery thereof. Bolts 97 and 99 extend through the lower cannister 93 so as to allow the lower cannister 93 to be secured to the support plate 81 by conventional means. Piston rod 28 is illustrated as extending outwardly of the lower cannister 93. An air inlet/outlet 101 is formed through the upper cannister 91 so as to allow air from the air hose 46 to be introduced into the interior of the air can 42.

In FIG. 4, it can be seen that the piston rod 28 is connected interior of the air can 42 to a piston 103. A return spring 105 will extend through the interior of the air can 42 so as to bear against the underside of the piston 103 and against the inner wall of the lower cannister 93. As a result, the return spring 105 will urge the piston 103 into the position shown in FIG. 4. As a result, when air pressure is not applied within the air can 42, the spring 105 will return the piston 103 toward the inner wall of the upper cannister 91. A rubber diaphragm 109 has its outer edges secured by the clamping bands 95 in the periphery between the upper cannister 91 and the lower cannister 93. Rubber diaphragm 109 will bear against the upper surface of the piston 103 so as to define the space 107 within the interior of the air can 42. When air is introduced through the air inlet 101, the air will fill the space 107 such that the rubber diaphragm 109 will exert a force upon the piston 103. This will drive against the resisting force of the spring 105 so as to cause the piston rod 28 to extend outwardly into the position shown in FIG. 2 herein.

FIG. 5 shows an isolated view of the clevis 26. The clevis 26 has a pivot opening 130 formed in a first flange member 132 and a second pivot opening 134 formed in a second flexible member 136. A space 138 is formed between the flange members 132 and 136 so as to allow for the receipt of the upper end of the punch arm 14 therein. A suitable connector 140 is formed at the top end 142 of the clevis 26 so as to allow for the attachment of piston rod 28 therein.

Figure 6:
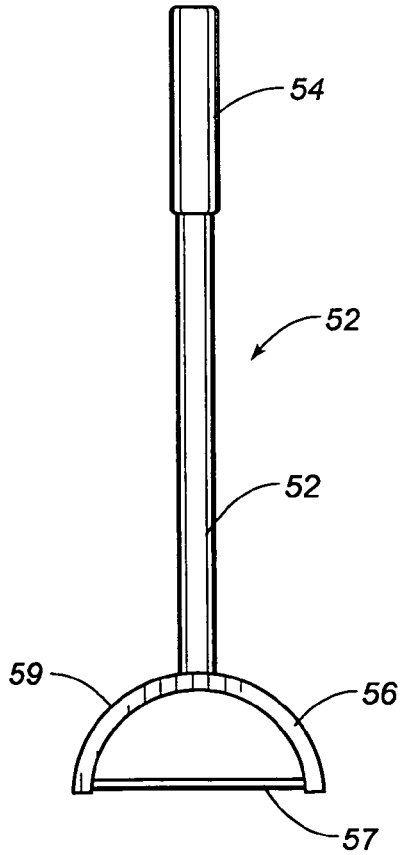
FIG. 6 is a plan view of the handle associated with the punch tool.

FIG. 6 is an isolated view of the handle 50 as used on the frame of the punch tool 10. Handle 50, as stated previously, has a gripping surface 54 formed at one end of the bar 52. Gripping surface 54 can be suitably rubber coated, knurled, or otherwise adapted so as to allow workers to easily grasp surface 54. The handle portion 56 is formed at the opposite end of the bar 52 from the gripping portion 54. Handle portion 56 is illustrated as having a generally C-shaped configuration. A crossbar 57 will extend between the ends of the C-shaped portion 59 so as to facilitate the grasping of the handle portion 56 and for the manipulation of the punch tool 10.

Figure 7:
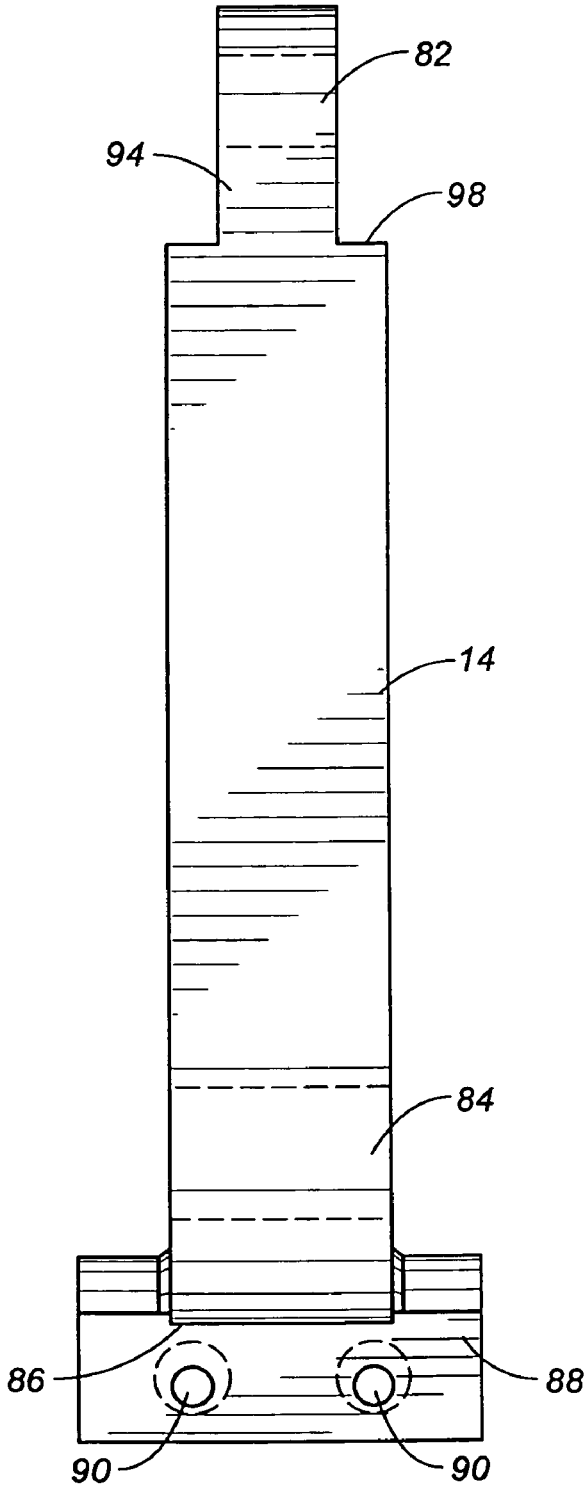
FIG. 7 is an end view showing the punch arm as used in the punch tool.
Figure 8:
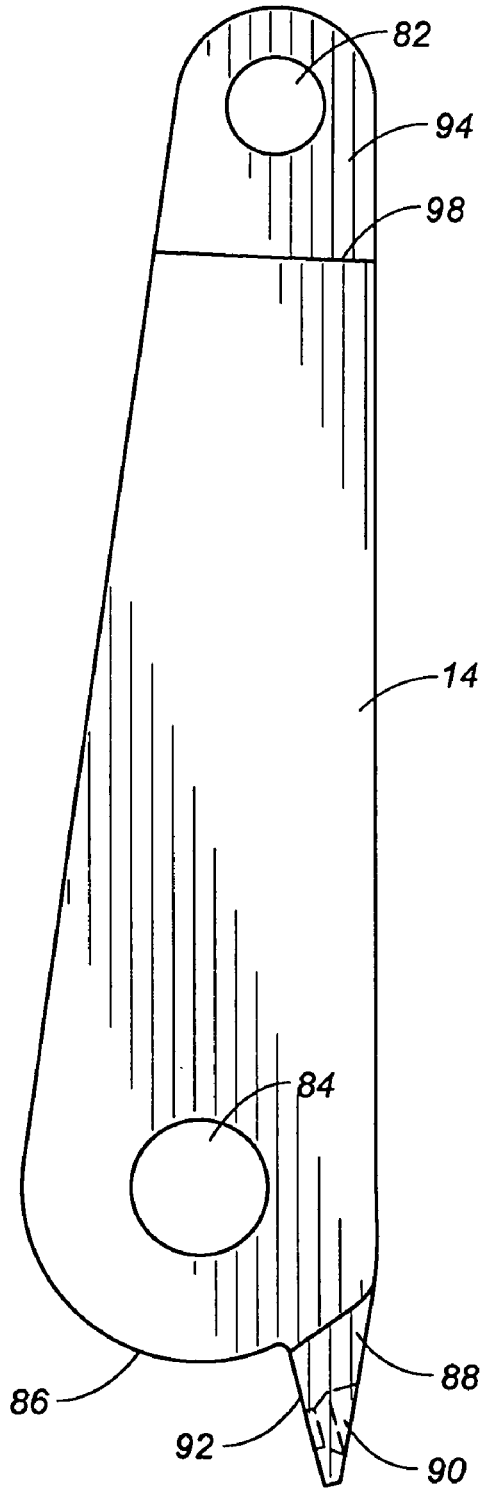
FIG. 8 is a side elevational view of the punch arm as used by the punch tool.

FIGS. 7 and 8 show an isolated view of the punch arm 14 associated with the present invention. Punch arm 14 has a pivot opening 82 at a top end thereof. A suitable pin can be installed through the pivot opening 82 so as to join the pivot opening 82 with the pivot openings 130 and 134 of clevis 26. Another pivot opening 84 is formed adjacent to the bottom 86 of the punch arm 14. Pivot opening 84 will allow a pin to be inserted through the pivot point 24 of the frame 12 so as to allow for the pivotal mounting of the punch arm 14 within the sides 73 and 75 of the frame 12. A downwardly extending portion 88 extends from one side of the bottom 86 of the punch arm 14. A suitable threaded support opening 90 is formed in this downwardly extending portion 88 so as to allow for the affixing of the male die 18 thereon. A surface 92 is formed on the downwardly extending portion 88 so as to face the downwardly extending portion associated with the frame 12.

The pivot opening 82 extends through flange 94 formed at the top 98 of the punch arm 14. The pivot opening 82 is formed so as to extend through the thickness of the flange 94. Downwardly extending arm 88 is formed at the bottom 86 of the punch arm 14. Threaded openings 90 are illustrated as extending through the thickness of the downwardly extending portion 88. As such, downwardly extending arm 88 forms a widened surface for supporting the male die 18 thereon.

Figure 9:
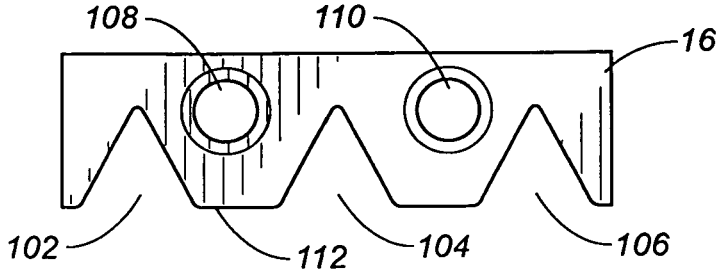
FIG. 9 is an isolated frontal view of the female die of the punch tool for the connection of deck sections.
Figure 10:
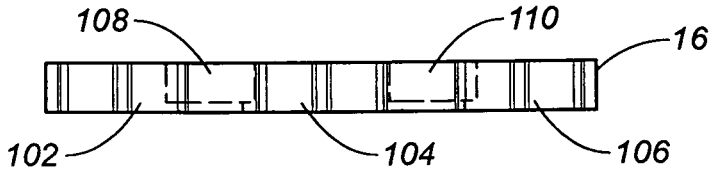
FIG. 10 is a plan view of the female die of the punch tool.

FIG. 9 is an isolated view of the female die 16. The female die 16 includes a plurality of inverted V-shaped openings 102, 104 and 106. Bolt openings 108 and 110 are provided through the female die 16 so as to allow for a joining with the threaded opening 80 associated with the downwardly extending arm of the frame 12. The V-shaped openings 102, 104 and 106 have a bottom surface which opens to the bottom edge 112 of the female die 16. FIG. 10 shows a cross-sectional top view of the female die 16.

Figure 11:
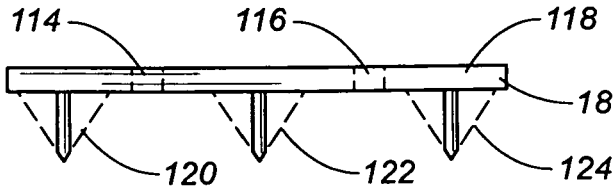
FIG. 11 is a plan view of the male die of the punch tool of the present invention for the formation of the triangular tabs.
Figure 12:
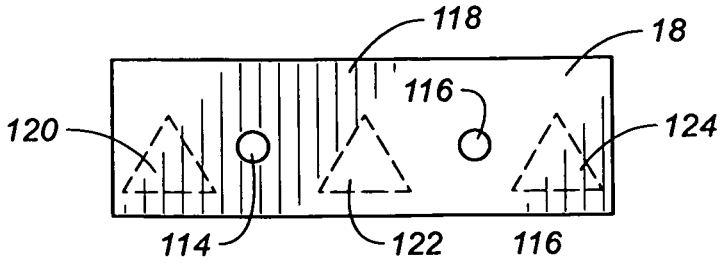
FIG. 12 is a frontal view of the male die of the punch tool.

In FIG. 11, it can be seen that the male die 18 has a pair of bolt holes 114 and 116 extending through the back surface 118 of the male die 18. The bolt holes 114 and 116 allow the male die 18 to be secured to the corresponding bolt openings 90 associated with the downwardly extending arm 88 of the punch arm 14. Importantly, male dies 120, 122 and 124 extend outwardly from the surface 118. Male dies have a generally pointed configuration so as to provide for a suitable puncturing and punching of the adjoining deck sections. Each of the male dies 120, 122 and 124 tapers from an outwardly extending point opposite to the surface 18 so as to widen toward the surface 118. In FIG. 12, it can be seen that the plurality of male dies 120, 122 and 124 have a generally triangular configuration suitable for mating with the inverted V-shaped die members 102, 104 and 106 of female die 16. Each of the male die members 120, 122 and 124 is spaced from each other in generally linear alignment along the backing surface 118. When the punch arm 14 is suitably pivoted about pivot point 24, the male die 18 will move toward the female die 16 and puncture the adjoining sections of steel decking therebetween.

FIG. 13 is an illustration of the cut made by the punch tool 10 for joining the sections 200 and 202 of steel decking 204. The relationship between the male die 18 and the female die 16 results in the inverted V-shaped cuts 206, 208 and 210 as formed in the decking 204. In particular, the deck section 200 has a male leg 212 in the form of an upwardly extending lip. Similarly, the deck section 202 has a female leg 214 of inverted U-shaped section having surfaces 215 and 217. The male leg will be received into the interior of the female leg 214 so that the deck sections 200 and 202 are loosely connected together. When the punch tool 10 is suitably actuated, the punches 206, 208 and 210 are suitably formed. These triangular tabs created by the punches 206, 208 and 210 assure a proper connection between the decking sections 200 and 202. The formation of these triangular-shaped cuts associated with punches 206, 208 and 210 prevent any lateral shifting of the sections 200 and 202 with respect to each other. Additionally, the triangular tabs 206, 208 and 210 establish a suitable connection which prevents sections 200 and 202 from pulling away from each other.

In particular, in FIG. 13, it can be seen that the triangular tabs 206, 208 and 210 extend outwardly generally transverse to the surface 215. In normal use, an inverted V-shaped cut will be formed in the second surface 217, through the male leg 212 and also through the first surface 215. The tabs 206, 208 and 210 extend generally co-linear with each other and in generally perpendicular relationship to the surface of the legs 212 and 214. A crimped area 219 is also formed by the punching tool along the length of the legs 212 and 214. Each of the tabs 206, 208 and 210 is spaced approximately one inch from each other. Each of the inverted V-shaped cuts used for the formation of the tabs 206, 208 and 210 has a base of approximately 5/16" and a height of approximately 3/8".

FIG. 14 shows a plan view showing the relationship of the inverted V-shaped cuts in the formation of the triangular tabs 206, 208 and 210. With respect to tab 210, it can be seen that the inverted V-shaped cut is in the form of a triangular section 221 that extends from the second surface 217 through the void created by the inverted V-shaped cut in the male leg 212 and through the void created by the inverted V-shaped cut in the first surface 215. Similarly, there is another triangular section 213 which is formed by the inverted V-shaped cut in the male leg 212. Finally, triangular section 225 extends outwardly from the inverted V-shaped cut made in the first surface 215. It can be seen that each of the triangular sections 221, 223 and 225 is slightly offset with respect to the section immediately therebelow. As a result, overhead inspection can easily determine whether the assembly has been properly carried out and completed. Each of the sections 221, 223 and 225 overlies each other in generally offset parallel planar relationship. The triangular tabs 206, 208 and 210 are illustrated as extending perpendicularly outwardly from the first surface 215. The crimping area 219 further assures that a tight connection between the male leg 212 and the female leg 214 is established.

FIG. 15 illustrates the specific relationship between these triangular sections 221, 223 and 225 which make up the triangular tab. In particular, in FIG. 15, it can be seen that the triangular section 221 is formed by the inverted V-shaped cut made in the second surface 217 of the female leg 214. The triangular section 223 is formed by the inverted V-shaped cut made in the male leg 212. Finally, the triangular section 225 is formed by the inverted V-shaped cut in the first surface 215 of the female leg 214.

In the method of the present invention, the attachment of the seams associated with deck sections 200 and 202 is a series of three upright triangular tabs 206, 208 and 210 that are sheared in an angle in the side lap of the steel interlocking deck . The male and female dies on the punch tool form these triangular tabs 206, 208 and 210 by penatrating through the male leg 212 and the female leg 214 of the side laps of each of the decks 200 and 202. During the shearing process, the side lap is crimped in crimping area 219 so that all three layers of steel are suitably compressed together. Both sides of triangular tabs are sheared and the base of the triangle remains intact with the side lap. When the process is complete, all three layers of steel are visible in the triangular tabs from above. The base of the triangle through the male leg of the deck side lap is the section that impedes the movement of the deck panels in relationship to each other.

The present invention serves to connect deck sections that will generate diaphragm shear values that are equivalent to or better than welded values. It is intended that this method of attachment will completely replace welds in the side lap of the deck sections.

The triangular tab design associated with the present invention will require relatively low cutting forces compared to other techniques of the prior art. As a result, it is possible to fit three triangular tabs on a single punch tool using a standard air can. It is also possible to use the same set of dies for numerous punches. The tool can be relatively light weight with minimal parts.

The technique of the present invention of providing a three tabs per seam attachment produces three bearing surfaces in order to resist shear movement in the deck panels. As a result, diaphragm shear values equal to or better than a typical top seam weld, similarly spaced, are achieved.

The seam attachment created by a stand-up pneumatic tool serves to reduce installation costs. The tool can be relatively simply operated by unskilled personnel. Unlike the prior techniques of welding, unskilled workers can use the present tool in order to make the proper seam connections between the deck sections. Additionally, more seam attachments per hour can be achieved than top seam welds. There are also fewer health issues associated with the installation technique of the present invention than would be associated with welding or other techniques.

Since the tabs extend at an angle with respect to the male and female legs, the tabs serve to resist vertical loads in a strong fashion. Since the tabs are relative blunt, injuries are avoided. Additionally, these blunt tabs also prevent laceration of equipment, such as hoses, cables or wires. Since the attachment of the seams of the deck sections are created by a die set, there will be no need for touch-up paint on the deck. Typically, in the past, welding would leave a burn mark after application to the side lap. Since no welding is required, no touch-up paint is required.

The present invention causes all three layers of steel from the side lap to be visible in the seam attachment. As a result, it is easier for operators and inspectors to verify the connection of the sections. The seam attachment apparatus and process of the present invention are applicable to a wide variety of various decking products.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A decking assembly comprising:

a first deck section having a male leg; and a second deck section positioned adjacent to and in overlapping relationship with said first deck section, said second deck section having a female leg overlying said male leg of said first deck section, said male leg and said female leg having a triangular tab formed therethrough such that said triangular tab extends inwardly on one side of said female leg, said female leg having a first surface positioned on one side of said male leg and a second surface positioned on an opposite side of said male leg, said triangular tab defined by a first inverted V-shaped cut formed in said second surface and bent inwardly toward said first surface, said triangular tab further defined by a second inverted V-shaped cut formed in said male leg and bent inwardly toward said second surface, said first and said second and said third inverted V-shaped cuts defining triangular sections in overlapping relationship to each other, the triangular section of said first and said second and said third inverted V-shaped cuts being offset inwardly from each other, said triangular tab comprising:

a first triangular tab;

a second triangular tab; and a third triangular tab, each of said triangular tabs extending in spaced relation to each other and oriented in the same direction in generally transverse relation to said male leg and such that surfaces of each of said triangular sections can be observed by a viewer thereabove.

2. The assembly of claim 1, said female leg being crimped such that said male leg is juxtaposed between said first and second surfaces of said female leg.

3. A decking assembly comprising:

a first deck section having a male leg; and a second deck section positioned adjacent to and in overlapping relationship with said first deck section, said second deck section having a female leg overlying said male leg of said first deck section, said male leg and said female leg having a triangular tab formed therethrough such that said triangular tab extends inwardly on one side of said female leg, said female leg having a first surface positioned on one side of said male leg and a second surface positioned on an opposite side of said male leg, said triangular tab defined by a first inverted V-shaped cut formed in said second surface and bent inwardly toward said first surface, said triangular tab further defined by a second inverted V-shaped cut formed in said male leg and bent inwardly toward said second surface, said triangular tab further defined by a third inverted V-shaped cut formed in said first surface and bent away from said second surface, said triangular tab comprising:

a first triangular tab;

a second triangular tab extending in spaced relationship to said first triangular tab; and a third triangular tab extending in spaced relationship to said second triangular tab, each of said first triangular tab and said second triangular tab and said third triangular tab extending longitudinally along an edge of the deck sections, each of said first triangular tab and said second triangular tab and said third triangular tab being oriented in an identical direction generally transverse to or slightly upwardly toward said male leg.

4. The assembly of claim 3, each of said first triangular tab and said second triangular tab and said third triangular tab being spaced approximately one inch from each other, each of said tabs having a base of approximately 5/16" and a height of approximately 3/8".

* * * * *